US005190799A

United States Patent [19]

Ellingson, III

[11] Patent Number: 5,190,799

[45] Date of Patent: Mar. 2, 1993

[54] FLOOR COVERING WITH INTEGRAL WALKING SURFACE

[75] Inventor: Chester W. Ellingson, III, Rosemount, Minn.

[73] Assignee: Reese Enterprises, Inc., Rosemount, Minn.

[21] Appl. No.: 697,807

[22] Filed: May 9, 1991

[51] Int. Cl.[5] ..... B32B 3/06

[52] U.S. Cl. ..... 428/53; 428/54; 428/99; 428/156; 428/167; 428/217; 52/180; 52/177; 15/215

[58] Field of Search ..... 428/53, 54, 217, 156, 428/167, 99; 52/180, 177; 15/215

[56] References Cited

U.S. PATENT DOCUMENTS

| | | | |
|---|---|---|---|
| Re. 32,061 | 1/1986 | Ellingson, Jr. | 428/52 |
| 2,181,812 | 11/1939 | Kammerer | 52/181 |
| 3,435,480 | 4/1969 | Mann, Jr. | 15/215 |
| 3,533,893 | 10/1970 | Hartstein | 161/66 |
| 3,676,280 | 7/1972 | Sands | 161/67 |
| 3,783,471 | 1/1974 | McGeary | 15/215 |
| 4,029,834 | 6/1977 | Bartlett | 428/62 |
| 4,321,294 | 3/1982 | Naka | 428/217 |
| 4,568,587 | 2/1986 | Balzer | 428/52 |
| 4,654,245 | 3/1987 | Balzer et al. | 428/52 |
| 4,663,903 | 5/1987 | Ellingson, Jr. | 52/187 |
| 4,766,020 | 8/1988 | Ellingson, Jr. | 428/54 |
| 4,804,570 | 2/1989 | Bedics | 428/53 |
| 4,877,672 | 10/1989 | Shreiner | 428/156 |
| 4,879,151 | 11/1989 | Ellingson, Jr. | 428/53 |

OTHER PUBLICATIONS

Reese; Perfec Clean Floor Mats & Grates, Dec. 1991, 12690/FEE BuyLine3090.

*Primary Examiner*—Alexander S. Thomas

*Attorney, Agent, or Firm*—Merchant, Gould, Smith, Welter & Schmidt

[57] ABSTRACT

A floor mat (10) is provided which includes longitudinal rail sections (e.g., 16, 17) capable of being interconnected with other longitudinal rails to form a roll up floor mat or pedestrian walking surface. The rails include a plastic cushion layer (21) which can be coextruded onto the upwardly facing surface of an underlying rigid plastic rail core (8), with the cushion layer being softer than the rail core and forming an integral walking surface thereon. At least one living hinge (23) may be employed within the rail section for pivotal movement of the rail, allowing the floor mat to be rolled up.

4 Claims, 1 Drawing Sheet

FLOOR COVERING WITH INTEGRAL WALKING SURFACE

FIELD OF THE INVENTION

This invention relates to an improved surface structure for a roll-up type floor covering mat or grille, and more particularly to a walking surface which is coextruded or otherwise sequentially bonded to the underlying rails which are interconnected to form the grille structure.

BACKGROUND OF THE INVENTION

Roll-up style floor covering mats or foot grille structures are in general use in public foyer areas and typically include a series of rails that are interconnected. Each of the rails usually includes a channel which receives a removable insert strip, the insert strips forming the actual surface upon which pedestrians walk. Typically, the strips are inserted into each rail by being pulled or pushed into its channel from one end thereof.

Ideally, such an insert strip should be relatively easy to install in the channel, yet relatively difficult to remove under normal use. However, in practice, the force used to insert the strip can permanently deform or elongate the strip such that it will not dimensionally match the channel over time. Several solutions have been proposed to this problem with limited success.

For example, U.S. Pat. No. 3,783,491, issued to F. L. McGeary, discloses a carpeted insert strip having a plastic backing material to prevent it from being easily pulled out the channel. Hartstein, U.S. Pat. No. 3,533,893, provides a tufted fabric strip heat sealed to a backing strip of paper, jute or a plastic material. Sands, U.S. Pat. No. 3,676,280, discloses a tufted carpet having a polymeric composition applied to its bottom surface.

U.S. Pat. No. 4,879,151, issued to Chester Ellingson, Jr., discloses an insert strip formed of suitable plastic materials through a dual durometer extrusion so as to provide a soft, non-slipping walking surface and a fairly rigid, reduced friction underlying surface which may be seated into a grille channel with the application of a longitudinal pulling force.

Shreiner, U.S. Pat. No. 4,877,672 discloses floor mats with rigid rails joined by living hinges, the rails having a body portion adapted to receive a tread member and a coupling portion by which it is joined to an adjacent rail, with the living hinges disposed in the coupling portion of the rail. However, the flexible hinges employed in the coupling portion have the problem of stretching or compressing, resulting in instability of the floor mat.

Therefore, there is a need for an attractive, functional floor covering which avoids the problems and disadvantages of prior floor coverings.

SUMMARY OF THE INVENTION

The present invention includes longitudinal rails capable of being interconnected with other longitudinal rails to form a roll up floor mat or pedestrian walking surface. The rails include a plastic cushion layer which can be coextruded on the upwardly facing surface of an underlying rigid rail core with the cushion being softer than the rail core. The rail core has a plurality of vertical members extending from its downwardly facing surface. In an alternate embodiment, a semi-rigid thermoplastic surface material may be adhesively bonded to the underlying grille material, whether the grille is plastic or metal in composition.

The surface of the cushion layer may be knurled, grooved or otherwise textured to provide a surface intended for direct pedestrian contact. The rails may contain one or more living hinges to allow for easy roll-up of the floor mat and can have a plurality of plastic foot strips covering the bottom portion of the vertical members. The rails may also have apertures therein to allow dirt or other particulate matter to be removed from the walking surface.

One aspect of the invention comprises the novel, longitudinal rails having an integral walking surface thereon. Another aspect of the invention comprises a floor covering employing the above rails. A further aspect of the invention comprises a method of forming the longitudinal rails of the invention.

DETAILED DESCRIPTION OF THE INVENTION

Figure 1:
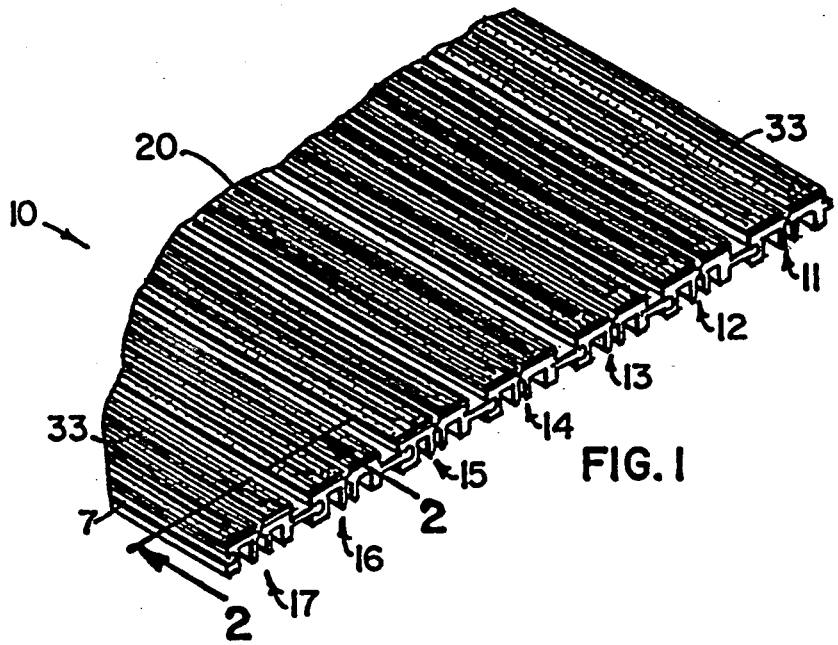
FIG. 1 is an elevational perspective view of a mat constructed according to the principles of the invention.

Referring to FIG. 1, depicted generally at 10 is a floor mat or floor covering having interconnected sections, each section having a suitable walking surface 20 integrally disposed on the floor covering. The sections may be connected by any variety of ball and socket arrangements as are well known in the art. Although the mat 10 may have any number of interconnected rail sections, sections 11, 12, 13, 14, 15, 16, and 17 are shown as an example of a typical portion of a floor covering.

Figure 2:
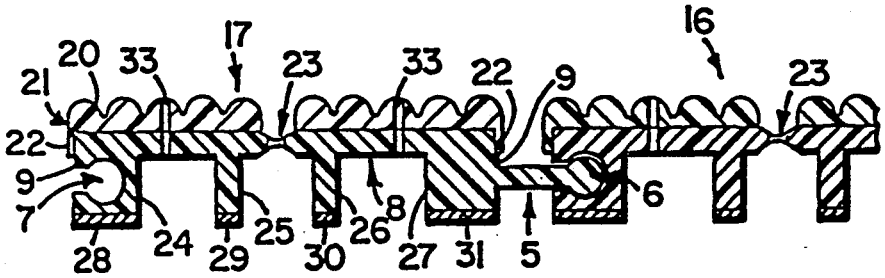
FIG. 2 is a side elevation of a portion of the mat depicted in FIG. 1.

As seen in FIG. 2, a side view of mat rail section 17 is shown, the rail section 17 being interconnected to adjacent rail section 16. In the particular arrangement shown, the sections 17 and 16 are interconnected by means of a web 5, the web 5 being formed of a rigid material. The web 5 is formed so as to have a knob 6 at an extremity of the web 5, the knob 6 being adapted to fit within a cavity or socket 7 extending longitudinally along the perimeter of mat sections 17 and 16.

In one embodiment of the present invention, exemplified by rail section 17 as shown in FIG. 2, a rigid rail core member 8 is formed either of a metallic material or a rigid thermoplastic material. In a preferred embodiment, rail core member 8 is composed of a rigid thermoplastic material such as rigid polyvinyl chloride (PVC), thereby permitting coextrusion of flexible material onto (and along with) the rail core member 8. The upper surface of rail core member 8 is formed as a substantially planar surface, which in use would tend to reside in a horizontal orientation.

Permanently positioned and integrally connected to the upper surface of rail core member 8 is a semi-rigid or flexible plastic cushion layer 21 which, in a preferred embodiment, is coextruded onto the upper surface of rail core member 8. The plastic cushion layer 21 is preferably formed of a flexible thermoplastic material such as flexible PVC. The exposed walking surface 20 of plastic cushion layer 21 may be knurled, grooved, furrowed or otherwise textured so as to provide not only additional surface area for frictional interaction with pedestrian traffic, but also to provide grooves or pathways for removing moisture or particulate matter.

Cushion layer 21 is formed so as to have lateral extension 22, with lateral extension 22 extending over and abutting the front and rear edges 9 of rail core member 8. In the embodiment shown, lateral extension 22 is oriented approximately 90° from the plane defined by the upper surface of rail core member 8, but in practice the front and rear edges 9 of rail core member 8 may be beveled or otherwise contoured such that lateral extension 22 is at a 45° or other angle with respect to the upper surface of rail core member 8. In any event, lateral extension 22 permits not only greater surface contact with rail member 8 but provides mechanical resistance to slipping or other differential movement between cushion layer 21 and rail core member 8.

Rail core member 8 also has a plurality of substantially vertical members 24, 25, 26 and 27 extending from its downwardly facing surface. Corresponding flexible thermoplastic foot strips 28, 29, 30 and 31 are adhered or coextruded to the bottom portions of the aforementioned vertical members providing a relatively large coefficient of friction with the floor surface (not shown) upon which the mat resides. A preferred flexible material for the aforementioned foot strips is polyurethane which is by nature a sticky non-slip material.

The rail core member 8 is further provided with a living hinge 23, allowing the rail to pivotally move when the floor mat is rolled up for cleaning and storage purposes. The living hinge 23 is in the form of a longitudinally continuous thin strand of a soft, flexible thermoplastic elastomer compound that exhibits high endurance to flexural fatigue. The flexural endurance to withstand many hundreds of cycles of rolling and unrolling of the mat is essential. Thermoplastic elastomers suitable for living hinges, such as polyurethane elastomers, are commercially available. The living hinge 23 is of hour-glass shape, which creates a zone of bending without stress risers and a comparatively large area of joinder to the adjacent rigid parts.

Rail section 17 is further provided with apertures or slots 33 to allow for the removal of dirt or other particulate matter from the surface of the mat. Slots 33 are preferably uniform in size and preferably are about ⅛ inch wide.

Figure 3:
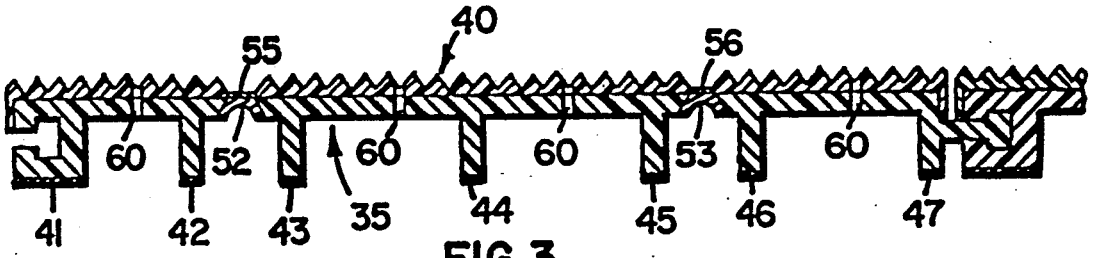
FIG. 3 is a side elevation of another embodiment of the invention.

FIG. 3 depicts an alternate embodiment of the invention in which the rail core member 35 is twice as wide as the rail core member 8 of FIG. 2. Rail core member 35 has substantially the same features as rail core member 8 such as a plastic cushion 40 on its upper surface and thermoplastic foot strips 41, 42, 43, 44, 45, 46 and 47 on the bottom portions of its vertical members. Rail core member 35 has two living hinges 52 and 53 disposed within it for pivotal movement of the rails when connected to form a floor mat, allowing the floor mat to be rolled up for cleaning and storage purposes. Hinging of the rails in two places means the rails will roll up just as easy and tightly as narrower rails having only one hinge.

In a preferred embodiment, the top layers 55 and 56 of the living hinges 52 and 53 are made out of the same material as the plastic cushion 40 such as flexible PVC, with the remaining part of the living hinges 52 and 53 made of a flexible thermoplastic material such as polyurethane. Polyurethane makes an excellent hinge material because it will flex almost indefinitely without breaking. The flexible PVC covering for the living hinges 52 and 53 will protect the polyurethane underneath from ultraviolet rays and moisture that might degrade the polyurethane.

Rail member 35 also is provided with apertures or slots 60 for removal of moisture and particulate matter from the upper surface of plastic cushion 40. The exposed upper surface of plastic cushion 40 may be knurled, grooved, furrowed or otherwise textured so as to provide not only additional surface area for frictional interaction with pedestrian traffic, but also to provide grooves or pathways for removing moisture or particulate matter through the apertures 60.

The rails of the present invention have many advantages such as that the walking surface can be extruded in line, avoiding the necessity of making a separate part that has to be assembled into the rail. Also, the use of wider rails such as shown in FIG. 3 means that there are less rails to assemble to obtain an equivalently sized mat.

The rail sections can be formed using dual-durometer extrusion to form the rail core member and plastic cushion walking surface. A triple durometer extrusion can be employed to produce the rail core member having the walking surface and plastic foot strips for the vertical members. The appearance of the mats is excellent because they can present an uninterrupted color since the walking surface covers the underlying rails. The walking surface can be pigmented or dyed in any desired color with any of a number of well known and commercially available pigments.

A method of making a longitudinal rail member capable of being interconnected with other longitudinal rails to form a pedestrian walking surface comprises the following steps. A rigid thermoplastic longitudinal rail core member is extruded having an upwardly facing surface and a downwardly facing surface with a plurality of vertical members extending therefrom. At the same time, a flexible thermoplastic cushion layer is coextruded in an abutting relationship with the upwardly facing surface of the rail core. Thus, mat rail members can be formed which provide a relatively soft, flexible surface layer, without requiring the additional step of inserting such a surface layer into the channel of an already formed rail member.

The mat is assembled by sliding successive rails endwise onto the last rail of the partly assembled mat. The male and female sides of each rail are preferably sonically welded once the rails have been joined together. Having the joints between rails sonically welded in conjunction with the small living hinge makes the resulting mats very stable in their lengthwise dimension. The problem of flexible hinges stretching or compressing is thus greatly reduced. Alternatively, the rails may be interconnected by mechanical means, such as small self tapping screws or mechanically applied metal staples.

The moderate flexibility of the polymeric materials of the mat affords moderate deformation of the rails, allowing the rails to conform somewhat by flexure to irregular floor surfaces in the lengthwise direction. The living hinges readily allow conformity of the mat to the supporting surface in the transverse direction. The plastic foot strips on the lower portion of the vertical members of the rails provides local compliance with slightly rough or uneven surfaces.

Various changes may be made in the form, details, arrangement and proportion of the parts shown herein without departing from the spirit and scope of the invention which, generally stated, includes an apparatus capable of carrying out the features of the present invention, and which is more particularly defined in the appended claims.

I claim:

1. A longitudinal rail capable of being interconnected with other longitudinal rails to form a pedestrian walking surface, the rail comprising:

(a) a rigid rail core having an upwardly facing surface, a downwardly facing surface with a plurality of vertical members extending therefrom, a front edge and a rear edge; and (b) at least one plastic cushion layer extending at least partially across the upwardly facing surface of said rail core, and at least partially around the front and rear edges of said rail core, said plastic cushion being softer than said rail core.

2. A longitudinal rail capable of being interconnected with other longitudinal rails to form a pedestrian walking surface, the rail comprising:

(a) an extruded plastic rail core having an upwardly facing surface, a downwardly facing surface with a plurality of vertical members extending therefrom, a front edge and a rear edge, and first and second perimeter regions wherein the first perimeter region is formed as a socket and the second perimeter region is formed as a web with a knob protruding therefrom;

(b) a plastic cushion layer coextruded on the upwardly facing surface of said rail core, said plastic cushion being softer than said rail core;

(c) at least one living hinge disposed between said first and second perimeter regions of said rail core; and (d) a plurality of plastic foot strips which extend over a bottom portion of said vertical members of said rail core intended to contact a floor when the pedestrian walking surface is laid upon the floor.

3. The rail of claim 2 wherein said rail core and said cushion layer are coextruded with said plastic foot strips.

4. A longitudinal rail capable of being interconnected with other longitudinal rails to form a pedestrian walking surface, the rail comprising:

(a) an extruded plastic rail core having an upwardly facing surface, a downwardly facing surface with a plurality of vertical members extending therefrom, a front edge and a rear edge, and first and second perimeter regions wherein the first perimeter region is formed as a socket and the second perimeter region is formed as a web with a knob protruding therefrom;

(b) a plastic cushion layer coextruded on the upwardly facing surface of said rail core and extruding at least partially around the front and rear edges of said rail core, said plastic cushion being softer than said rail core;

(c) at least one living hinge disposed between said first and second perimeter regions of said rail core; and (d) a plurality of plastic foot strips which extend over a bottom portion of said vertical members of said rail core intended to contact a floor when the pedestrian walking surface is laid upon the floor.

* * * * *